US006467299B1

(12) United States Patent
Coetzee

(10) Patent No.: US 6,467,299 B1
(45) **Date of Patent: *Oct. 22, 2002**

(54) CONTAINER FOR A VIAL OR AMPOULE

(75) Inventor: Jan Frederick Coetzee, Lynwood (ZA)

(73) Assignee: Triple CCC CC (ZA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 391 days.

(21) Appl. No.: 09/242,887

(22) PCT Filed: Aug. 29, 1997

(86) PCT No.: PCT/EP97/04877

§ 371 (c)(1),
(2), (4) Date: Apr. 9, 1999

(87) PCT Pub. No.: WO98/09120

PCT Pub. Date: Mar. 5, 1998

(30) Foreign Application Priority Data

Aug. 30, 1996 (ZA) ..... 96/7362

(51) Int. Cl.[7] ..... F25D 25/00
(52) U.S. Cl. ..... 62/457.2; 62/371; 62/530
(58) Field of Search ..... 62/530, 457.2, 62/371

(56) References Cited

U.S. PATENT DOCUMENTS

| | | | | | |
|---|---|---|---|---|---|
| 3,974,658 A | | 8/1976 | Starrett | 62/60 |
| 4,292,817 A | | 10/1981 | Loucks | 62/457 |
| 4,474,033 A | | 10/1984 | Baker | 62/457 |
| 4,498,312 A | * | 2/1985 | Schlosser | 62/530 |
| 4,826,025 A | | 5/1989 | Abiko et al. | 215/32 |
| 5,129,566 A | | 7/1992 | Ogden et al. | 225/93 |
| 5,243,835 A | * | 9/1993 | Pandamsee | 62/530 |
| D340,519 S | | 10/1993 | Ogden et al. | D24/130 |
| 5,355,684 A | * | 10/1994 | Guice | 62/457.2 |
| 5,435,142 A | * | 7/1995 | Silber | 62/60 |
| 5,758,513 A | * | 6/1998 | Smith | 62/530 |
| 5,924,302 A | * | 7/1999 | Derifield | 62/457.2 |

* cited by examiner

*Primary Examiner*—William Doerrler
*Assistant Examiner*—Mark Shulman
(74) *Attorney, Agent, or Firm*—Townsend and Townsend and Crew LLP

(57) ABSTRACT

A portable container (10) suitable for housing and protecting vials (Y) ampoules and other small vessels containing pharmaceutical or veterinary preparations such as vaccines, which are sensitive to changes in temperature or to relatively high temperature, is provided. The container (10) comprises a layered wall (11) defining a centrally located cavity (13) for receiving the vial (Y). The wall (11) includes an outer thermally insulating layer (12) surrounding a substance (14) for providing a passive cold source to the cavity (13) and two spaced inner layers (16 and 18) of a relatively hard plastics material providing an annular chamber wherein the substance (14) is received.

5 Claims, 6 Drawing Sheets

CONTAINER FOR A VIAL OR AMPOULE

INTRODUCTION AND BACKGROUND TO THE INVENTION

This invention relates to a portable container which is specifically adapted for holding and protecting vials and ampoules and their contents. The articles to be protected will be termed vials in this specification, which term shall include within its scope ampoules, and other small vessels and their contents such as vaccines and the like. This invention further relates to a portable container for the passive cooling of vials. The container is particularly suitable for housing and protecting vials containing pharmaceutical or veterinary preparations such as vaccines which are sensitive to changes in temperature or to relatively high temperature.

Vials are generally supplied in boxes, which may contain ten or more vials, to pharmacists, veterinary surgeons or other drug supply facilities. A disadvantages of these boxes is that the vials are not thermally insulated by the boxes during transportation and storage. Where the contents of the vials are sensitive to changes in temperature, an additional isolating container has to be provided to protect the vials against extreme temperatures and sudden changes in temperature. Opening of the isolating container to remove one of the vials, will raise the temperature inside the container to the detriment of the other vials.

Certain vaccines, which are dispensed from vials, have to be maintained at a temperature of between 2° and 8° C. An example of such vaccine is a SAIMR ABSORBED TETANUS vaccine. Transportation, storage and dispensing of these vaccines in remote and underdeveloped areas is relatively difficult, if not impossible with known vial containers.

When a pharmacist supplies one or more vials to a patient, the pharmacist will remove the required number of vials from a box in which the vials are contained and may place the vials into another packet, box or suitable container. A disadvantage of this is that the vials are unprotected from damage and because the vials are also usually made of glass, they will easily shatter in the event of the packet or box being dropped.

OBJECT OF THE INVENTION

It is accordingly an object of the present invention to provide a portable container for vials with which the aforesaid disadvantages may be overcome or minimised or to provide a useful alternative to the known vial containers.

SUMMARY OF THE INVENTION

According to the invention there is provided a portable container as set forth in the claims.

According to the invention there is provided a portable container for a vial, the container having a wall defining a centrally located cavity for receiving the vial, the wall having a first thermally insulating outer layer; and second and third spaced apart layers of a relatively hard plastics material surrounded by the first layer, the second and third layers defining a cavity between them for a substance for providing a passive cold source to the cavity; and the wall including a fourth insulating inner layer which is surrounded by the other layers. vial, the container having a wall defining a centrally located cavity for receiving the vial, the wall having a first thermally insulating layer surrounding a substance for providing a passive cold source to the cavity.

Preferably the substance is provided in semi-solid, gel or liquid form, and is selected from the group comprising sodium acetate, polyethylene glycol, silicone based compounds, glycol alcohols, water, and polymers.

Further according to the invention the wall includes second and third spaced apart layers of a relatively hard plastics material and the substance for providing a passive cold source forms an annular layer disposed between the second and third layers.

The wall may include a fourth insulating inner layer which is surrounded by the other layers.

Further according to the invention the first to fourth layers are in the form of concentrically disposed, cylindrical, blind ended tubes.

Preferably the container has a closed bottom and an open top and the container may include a thermally insulating lid for closing the open top.

The wall may be provided with a connecting formation and the lid may define a complementary formation for cooperating with the connecting formation.

The container may include a downwardly directed annular flange member provided on the open top of the container, the flange member connecting to the first layer of the container by a friction fit.

An inner surface of the annular flange member may define an annular extending groove formation and an outer surface of the second layer may define a circumferentially extending ridge formation for mating with the groove formation.

The first layer may comprise polyurethane foam or expanded polystyrene foam.

In one form of the invention, an inner surface of the fourth layer is profiled to provide protrusions for abutting the outer surface of the vial and for defining an air filled buffer zone between the vial and the substance for providing a passive cold source.

In another form of the invention, the lid is provided with at least one gripping formation for gripping one end of the vial.

In yet another form of the invention, the lid includes an axially aligned pierceable disc which is adapted to be pierced by the needle of a syringe, the container being adapted to contain a vial having a similar pierceable top.

The container may include an outer protective skin.

BRIEF DESCRIPTION OF THE DRAWINGS

The invention will now be described further, by way of example only, with reference to the accompanying drawings wherein.

DESCRIPTION OF PREFERRED EMBODIMENTS OF THE INVENTION

Figure 1:
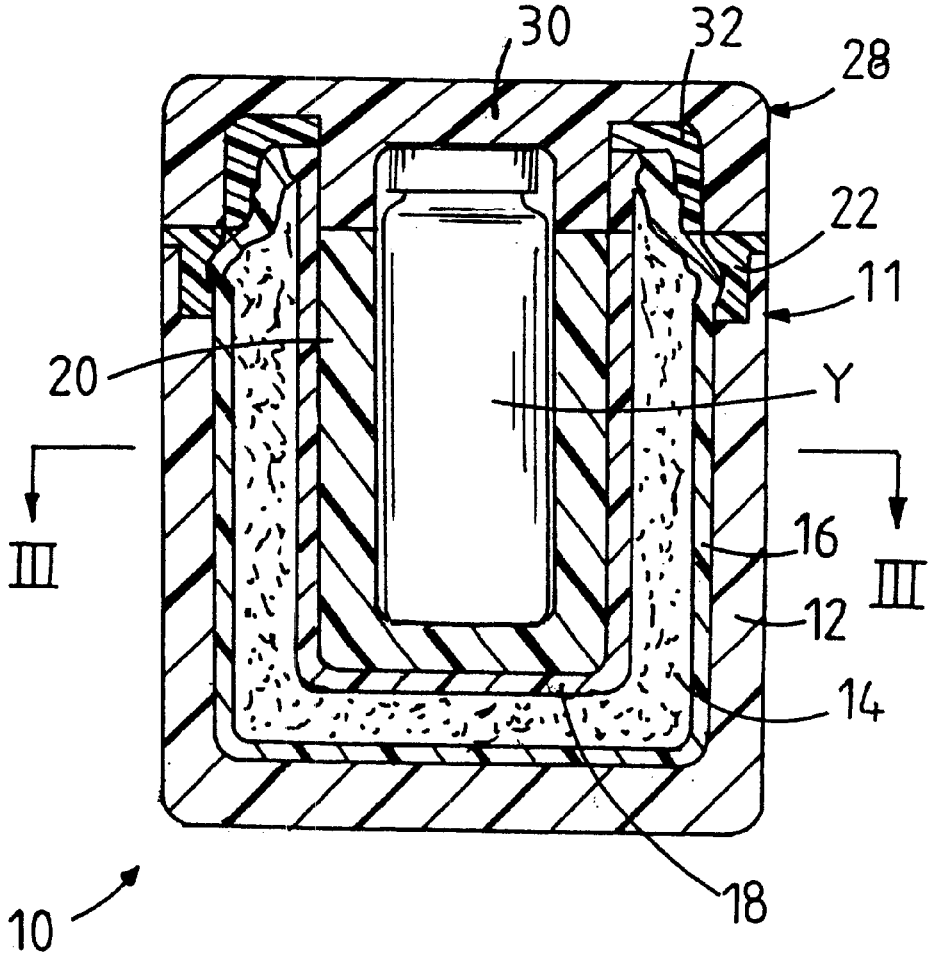
FIG. 1 is a longitudinal sectional side view of a portable container according to a first embodiment of the invention for a vial.
Figure 2:
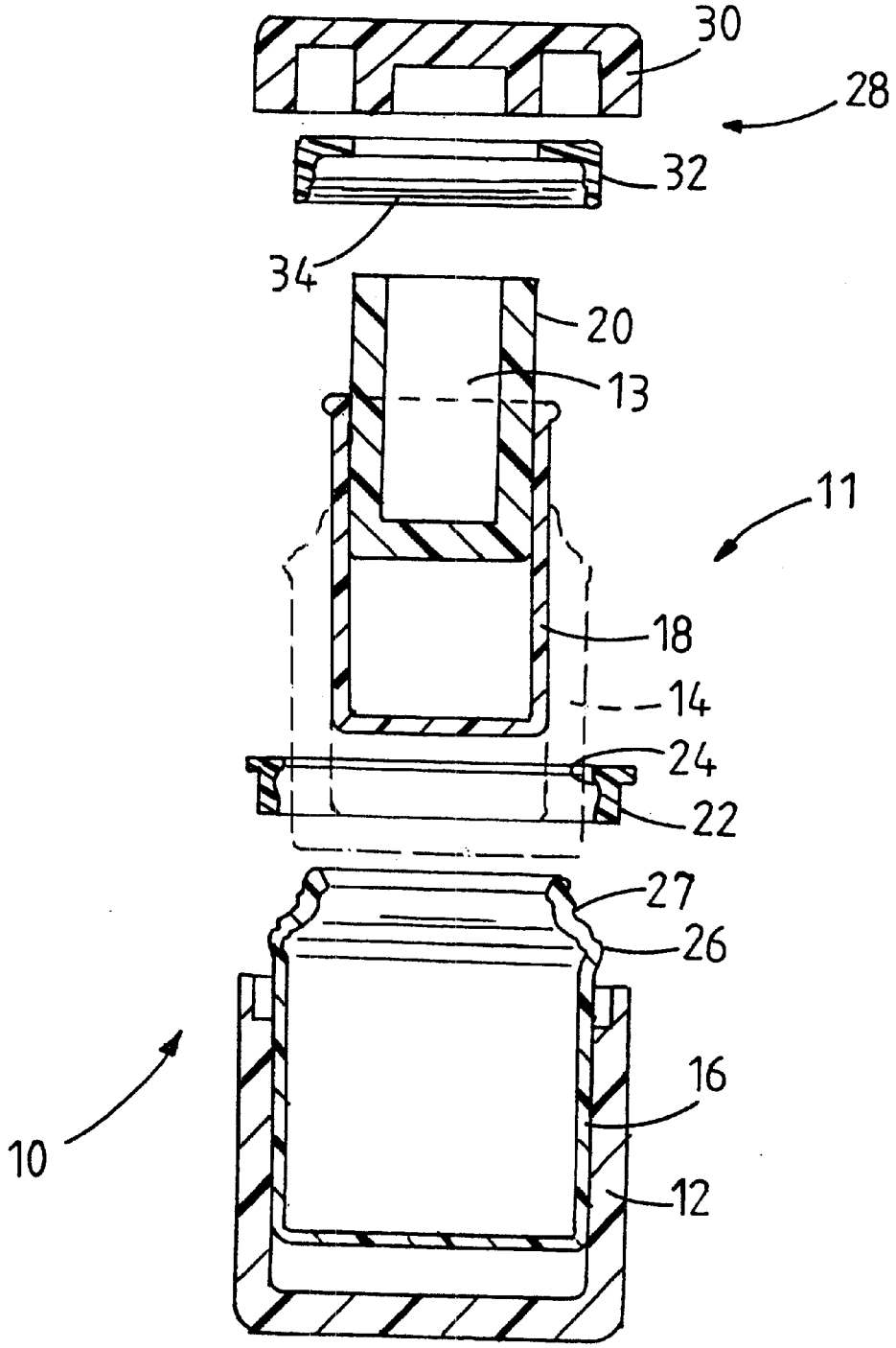
FIG. 2 is a longitudinal sectional exploded side view of the container of FIG. 1.
Figure 3:
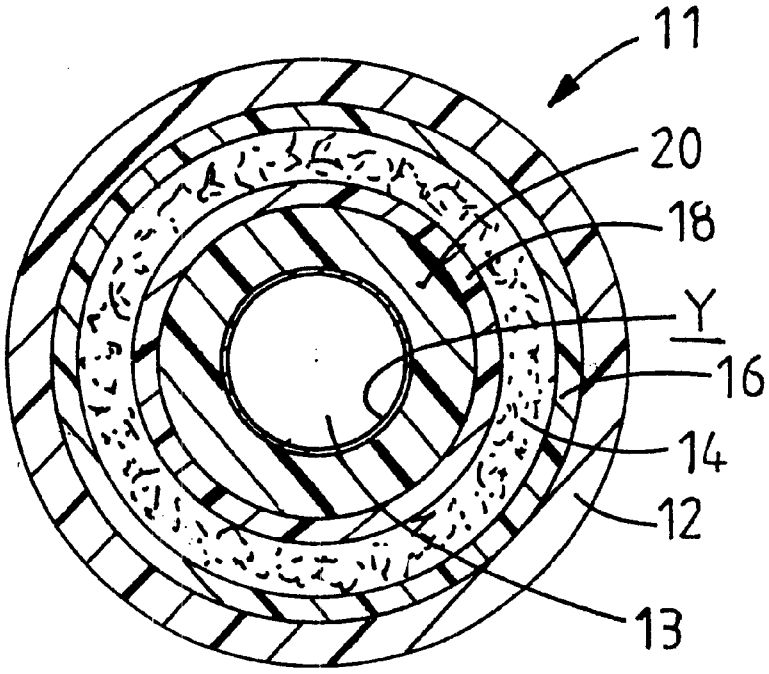
FIG. 3 is a cross-sectional view along line III—III in FIG. 1.

Referring to FIGS. 1 to 3, a portable container according to a first embodiment of the invention, for a vial is generally designated by reference numeral 10.

The container 10 has a wall 11 defining a centrally located cavity 13 (FIGS. 2 and 3) for receiving a vial Y (FIG. 1). The wall 11 is constituted from four tubular blind ended concentrically disposed layers 12, 16, 18 and 20. The first and fourth layers 12 and 20 are of a thermally insulating material; preferably of polyurethane foam or expanded polystyrene foam.

The container 10 further includes a substance 14 for providing a passive cold source and surrounding the cavity 13. The substance 14 may be in solid, gel or liquid form, and is selected from the group including sodium acetate, polyethylene glycol, silicone based compounds, glycol alcohols, water, and polymers. Preferably the substance 14 comprises a gel of the type which is commonly used in cold packs with cooler boxes, the gel also being known as pharmaceutical gel. The substance 14 is disposed between the spaced apart second and third layers 16 and 18 which are both of a relatively hard plastics material, preferably high density polyethylene. In this embodiment of the invention, the inner fourth layer 20 is shaped and sized to receive a single vial Y. The upper edges of the second and third layers 16 and 18 are connected to each other.

Referring particularly to FIG. 2, a downwardly extending annular flange 22 is connected to the open top of the first layer 12 via a friction fit and an inner surface of the flange 22 defines an annular extending groove formation 24. An outer surface of the second layer 16 defines a circumferentially extending ridge formation 26 for mating with the groove formation 24.

Referring still to FIG. 2, the open top of the wall 11 is provided with a connecting formation in the form of external screw thread 27 defined by the second layer 16. The container 10 further includes a lid 28 comprising a profiled disc 30 of expanded polystyrene foam having an annular insert 32 of a plastics material such as high density polypropylene. The insert 32 is provided with a complementary formation in the form of internal screw thread 34 for cooperating with the screw head 27 defined by the second layer 16.

In use, the container 10 is opened and placed in a freezer (not shown) to lower the temperature of the substance 14, so that the substance 14 provides a passive cold source. The container 10 is removed from the freezer and the vial Y placed inside the cavity 13 and the container 10 closed by the lid 28.

It will be appreciated that the contents of the vial Y is protected against sudden changes in temperatures by the first layer 12 insulating the container 10 and by the substance 14 providing a passive cold source. The fourth layer 20 serves to protect the vial Y from a sudden excessive drop in temperature due to the proximity of the vial Y to the substance 14. The container 10 containing the vial Y may thus be transported and stored outside for a substantial period without a significant change in the temperature of the contents of the vial Y. Temperature sensitive contents of a vial can thus be protected against excessive temperatures by maintaining a cold chain by use of a container 10 according to the invention. For example, a manufacturer can place a vaccine containing vial, which is ideally kept at a temperature of between 2 and 8 degrees Celsius, inside the container 10 and send the container 10 to a consumer. It was found that the contents of the vial Y can be maintained within the above temperature range for a period of approximately 24 hours or longer, using the container 10 according to the invention.

EXAMPLE

The efficiency of a container 10 according to the first embodiment was tested using a method including the steps of:

a) preparing an empty capped 10 ml vial by:
   removing the cap of the vial;
   inserting a suitable tube of a plastics material through the centre of the cap;
   filling the vial with 10 ml water; and
   replacing the cap;
b) storing the prepared vial in a refrigerator for at least 2 hours at a temperature of between 2 to 8 degrees Celsius;
c) opening the container and storing the container in a freezer at a temperature of approximately −20 degrees Celsius for at least 12 hours;
d) inserting a thermocouple through the tube into the vial and locating the thermocouple approximately in the centre of the vial;
e) placing the vial inside the container and closing the container by the lid and removing the container from the freezer; and
f) recording the temperature of the volume of water contained in the vial at regular intervals at an outside temperature of approximately 21 degrees Celsius.

The recorded results of the method described above, are shown in FIG. 9.

Figure 4:
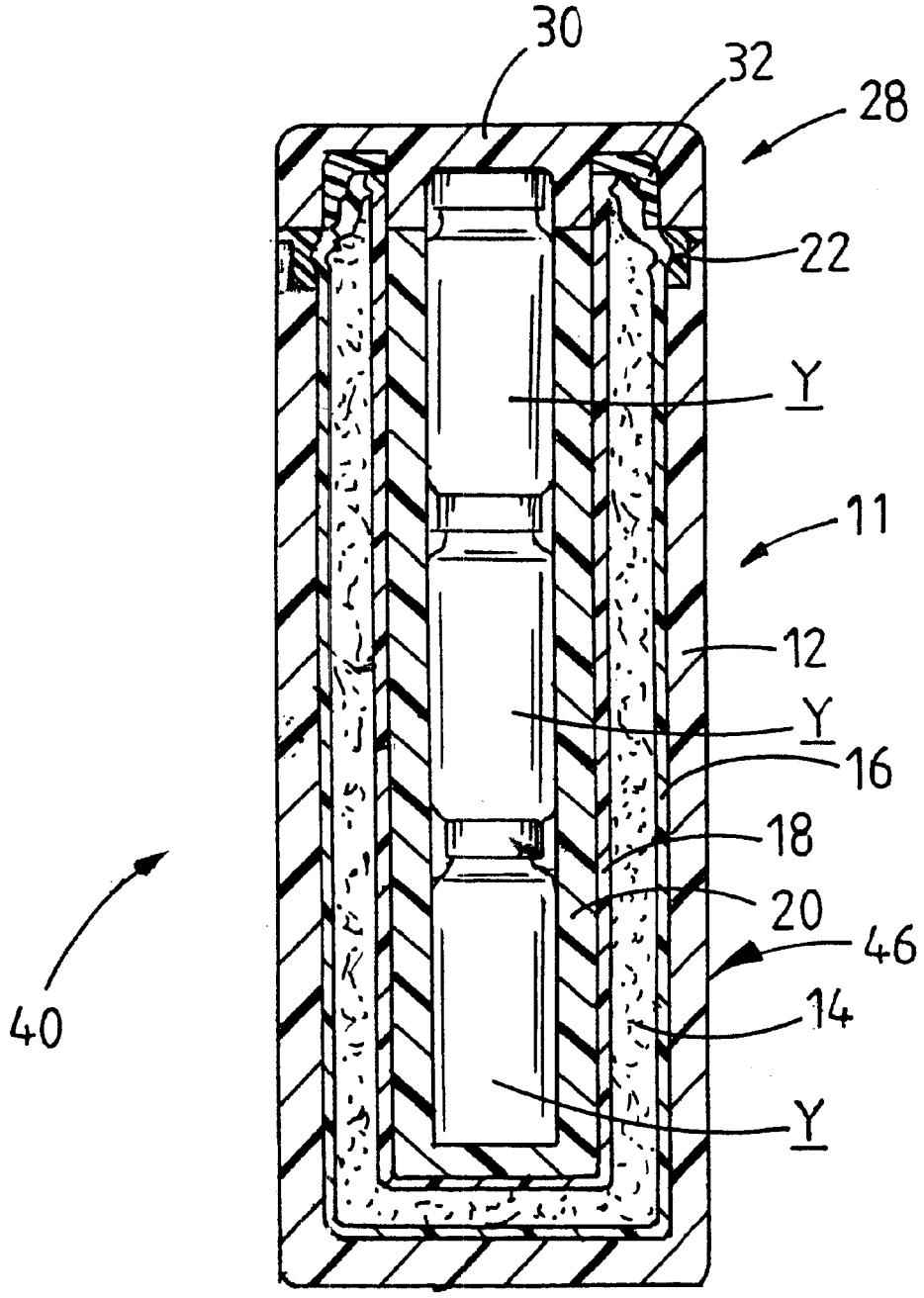
FIG. 4 is a longitudinal sectional side view of a portable container according to a second embodiment of the invention for a vial.

Referring to FIG. 4, a portable container according to a second embodiment of the invention for a vial is generally designated by reference numeral 40. The container 40 is similar to the container 10, with the exception that the container 40 is relatively longer so that a plurality of vials Y can be received inside the container 40 in end to end relationship. A further exception is that the container 40 is provided with a protective coating 46 such as shrink wrap.

Figure 5:
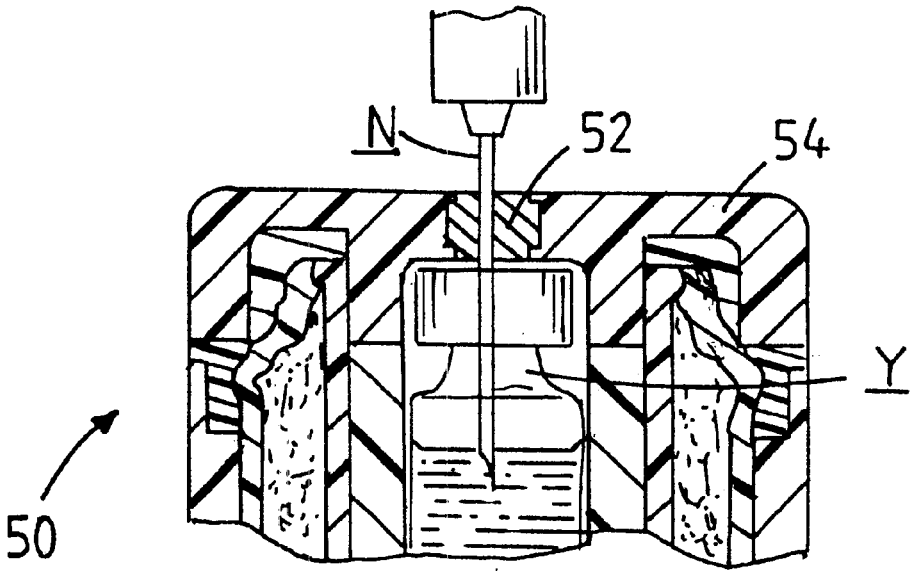
FIG. 5 is a longitudinal sectional side view of an upper portion of a portable container according to a third embodiment of the invention for a vial.

Referring to FIG. 5, an upper portion of a portable container according to a third embodiment of the invention for a vial is shown in cross-section and is generally designated by reference numeral 50. The container 50 is similar to the container 10, with the exception that the container 50 is provided with an axially pierceable disc 52 which is incorporated into the lid 54 of the container 50. The disc 52 is adapted to be pierced by the needle N of a syringe and the container 50 is further adapted to contain a vial Y having a similarly pierceable top. It will be appreciated that with a container 50, the contents of the vial Y can be dispensed without opening the container 50.

Figure 6:
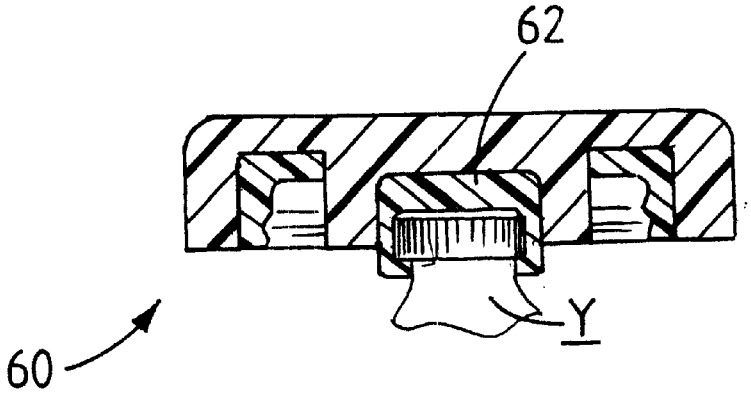
FIG. 6 is a longitudinal sectional side view of an upper portion a portable container according to a fourth embodiment of the invention for a vial.

Referring to FIG. 6, a lid of a portable container to a fifth embodiment of the invention for a vial is generally designated by reference 60. The lid 60 is similar to the lid 28 of the container 10, with the exception that the lid 60 is provided with a gripping means 62 for gripping the cap of a vial Y received in the container (not shown). Preferably the gripping means 62 comprises a body of foamed plastic embedded in the lid 60. It will be appreciated that the advantage of the lid 60 is that the vial Y is lifted from the container when opening and lifting the lid 60.

Figure 7:
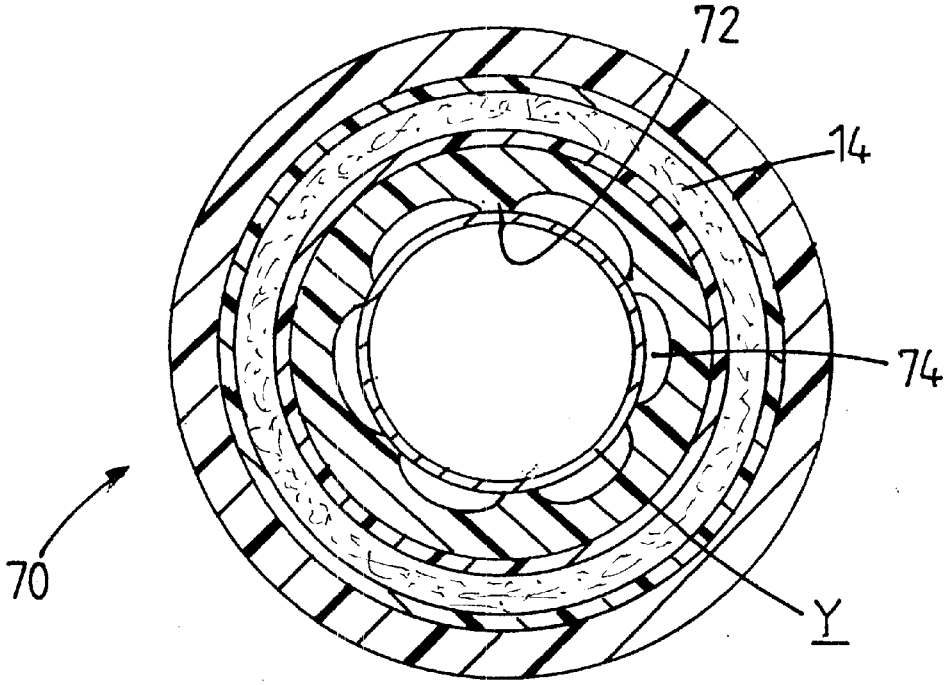
FIG. 7 is a cross-sectional plan view of a portable container according to a fifth embodiment of the invention for a vial.
Figure 8:
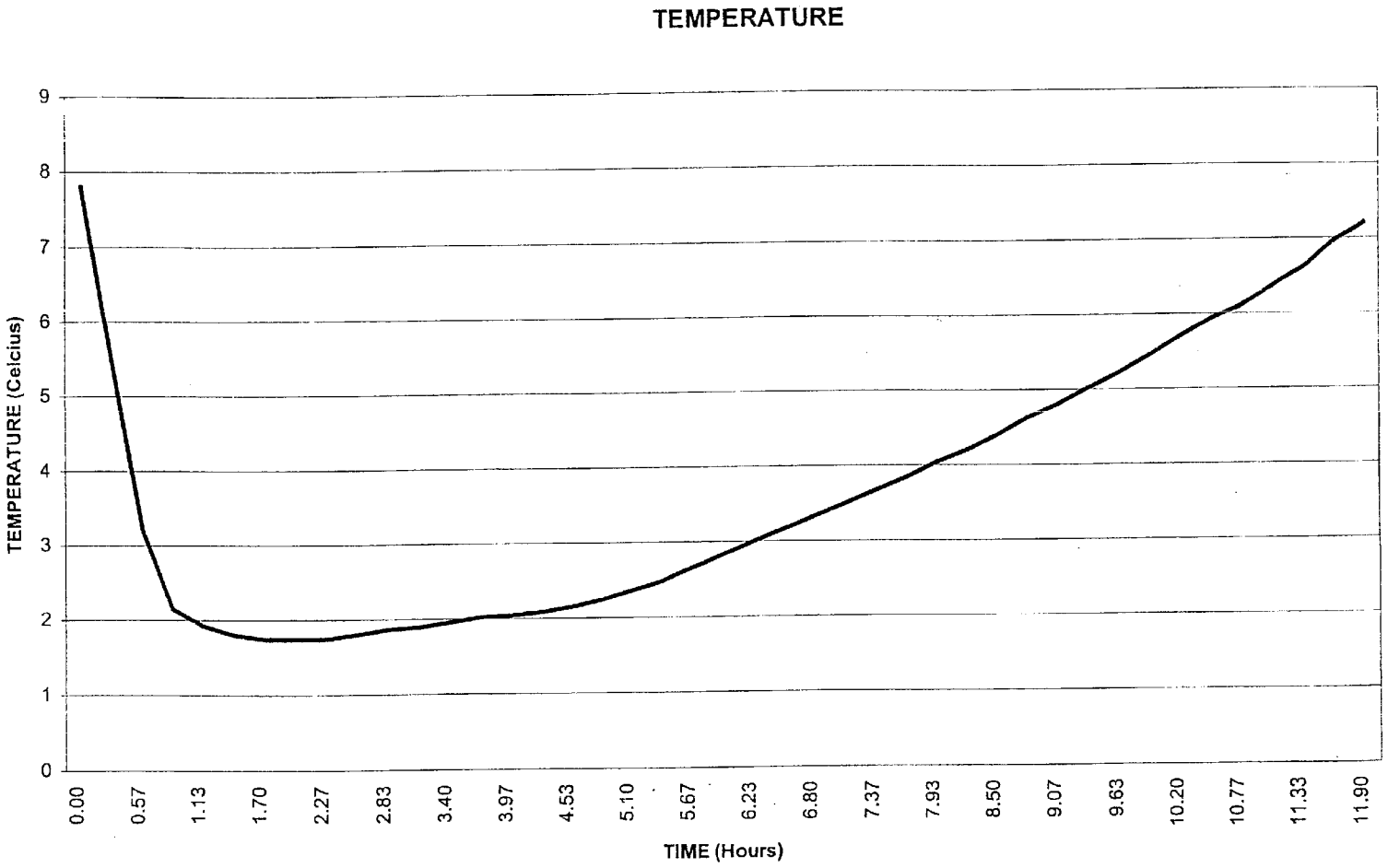
FIG. 8 illustrates the efficiency of a container according to the first embodiment of the invention.

Referring to FIG. 7, a container according to a sixth embodiment of the invention for a vial Y is shown in cross-section and is generally designated by reference numeral 70. The container 70 is similar to the container 10, with the exception that the inner surface of the container 70 is profiled to provide a plurality of inwardly directed projections 72 for spacing the vial Y from the substance 14, so that a buffer space 74, which prevents temperature shocks to the contents of the vial Y, is defined between the vial Y and the substance 14.

It will be appreciated that a label designating the contents of the vial can be applied to the outer surface of any of the containers described above.

It will be appreciated further that the invention is not limited to any of the embodiments depicted herein but that the portable containers described herein will prove to be effective dispensing tools for the protection and dispensing of vials and ampoules. Not only will a vial to an extent be thermally insulated and passively protected against excessive temperatures when in a container according to the invention, but the container will also protect the vial against damage due to excessive shocks. The container also serves as a convenient body onto which a label can be placed so as to identify the contents thereof.

It will be appreciated even further that a large number of variations in detail are possible with portable containers according to the invention without departing from the scope and/or spirit of the appended claims.

What is claimed is:

1. A portable container for a vial, the container having a wall defining a centrally located cavity for receiving the vial, the wall having a first thermally insulating outer layer; and second and third spaced apart layers of a relatively hard plastics material surrounded by the first layer, the second and third layers defining a cavity between them for a substance for providing a passive cold source to the cavity; and the wall including a fourth inner layer of insulating foam which is surrounded by the other layers, for protecting the vial from a sudden excessive drop in temperature due to the proximity of the vial to the passive cold source.

2. A container according to claim 1 wherein the first to fourth layers are in the form of concentrically disposed, cylindrical, blind ended tubes.

3. A container according to claim 2 wherein the substance for providing a passive cold source forms an annular layer disposed between the second and third layers.

4. A container according to claim 1 which includes a downwardly directed annular flange member providing on the open top of the container, the flange member connecting to the first layer of the container by a friction fit.

5. A container according to claim 1 wherein an inner surface of the annular flange member defines an annular extending groove formation and wherein an outer surface of the second layer defines a circumferentially extending ridge formation for mating with the groove formation.

* * * * *